US010322853B2

(12) United States Patent
Castillo et al.

(10) Patent No.: US 10,322,853 B2
(45) Date of Patent: Jun. 18, 2019

(54) APPARATUS AND METHOD FOR SECURING A VESSEL

(71) Applicant: GENERAL ELECTRIC COMPANY, Schenectady, NY (US)

(72) Inventors: Edward Castillo, Milwaukee, WI (US); Paul Wervey, Mukwonago, WI (US)

(73) Assignee: General Electric Company, Schenectady, NY (US)

( * ) Notice: Subject to any disclaimer, the term of this patent is extended or adjusted under 35 U.S.C. 154(b) by 79 days.

(21) Appl. No.: 15/365,155

(22) Filed: Nov. 30, 2016

(65) Prior Publication Data

US 2018/0148232 A1 May 31, 2018

(51) Int. Cl.

| | |
|---|---|
| ***B65D 41/34*** | (2006.01) |
| ***B65D 41/58*** | (2006.01) |
| ***B65D 51/18*** | (2006.01) |
| ***B65D 39/00*** | (2006.01) |

(52) U.S. Cl.

CPC ..... *B65D 41/3457* (2013.01); *B65D 39/0005* (2013.01); *B65D 41/58* (2013.01); *B65D 51/18* (2013.01); *B65D 2251/009* (2013.01); *B65D 2251/0015* (2013.01); *B65D 2251/0028* (2013.01); *B65D 2251/0046* (2013.01); *B65D 2251/0059* (2013.01); *B65D 2251/0075* (2013.01); *B65D 2251/0078* (2013.01)

(58) Field of Classification Search

CPC . B65D 41/3457; B65D 39/0005; B65D 55/00
See application file for complete search history.

(56) References Cited

U.S. PATENT DOCUMENTS

| | | | | |
|---|---|---|---|---|
| 2,162,752 | A * | 6/1939 | Schauer | B65D 41/3404 215/251 |
| 5,320,233 | A * | 6/1994 | Welch | B65D 41/36 215/252 |
| 5,895,383 | A | 4/1999 | Niedospial, Jr. | |
| 5,902,298 | A | 5/1999 | Niedospial, Jr. et al. | |
| 6,006,932 | A * | 12/1999 | Morini | B65D 51/002 215/204 |
| 7,118,003 | B2 | 10/2006 | Sellari et al. | |
| 7,198,170 | B2 * | 4/2007 | Herr | B65D 41/06 215/222 |
| 7,988,004 | B1 * | 8/2011 | Marret | B65D 47/242 215/252 |
| 8,807,360 | B2 * | 8/2014 | Erspamer | B65D 41/3428 215/252 |

(Continued)

*Primary Examiner* — Shawn M Braden
(74) *Attorney, Agent, or Firm* — Grogan, Tuccillo & Vanderleeden, LLP

(57) ABSTRACT

An apparatus for securing a vessel includes a primary cap having a threaded portion that is configured to selectively engage corresponding threads of a vessel to secure the primary cap to the vessel, and at least one projection. The apparatus further includes a removable secondary cap configured to engage the primary cap to secure the vessel, the secondary cap including at least one lug, the lug having a shear zone that contacts the projection when the primary and secondary caps are engaged and secured to a vessel. When the secondary cap is removed from the primary cap, the shear zone is broken by the projection such that the secondary cap cannot by reinstalled on the primary cap.

19 Claims, 4 Drawing Sheets

(56) References Cited

U.S. PATENT DOCUMENTS

| | | | | |
|---|---|---|---|---|
| 2007/0102392 | A1* | 5/2007 | Hoepner | B65D 47/0885 215/237 |
| 2013/0214004 | A1* | 8/2013 | Dejonge | B65D 50/061 222/153.11 |

* cited by examiner

APPARATUS AND METHOD FOR SECURING A VESSEL

BACKGROUND

Technical Field

Embodiments of the invention relate generally to securing vessels, and more specifically, to an apparatus and method for securing a vessel containing media for use in a medical imaging procedure.

Discussion of Art

Generally, medical imaging is used to survey internal biological structures or fluids for diagnostic purposes. Common types of imaging include x-ray radiography, magnetic resonance imaging (MRI), angiography, computed tomography (CT) and ultrasonography. To enhance the contrast of structures or fluids so that they can be more clearly visualized during an imaging procedure, contrast media or agents are often utilized. For example, in x-ray radiography, iodine and barium are typically used, and in MRI, gadolinium is a commonly employed contrast agent. Moreover, in certain applications, other liquid, solid, and/or gas media, such as, for example, saline to flush a contrast agent, may be dispensed or injected into a biological structure in connection with an imaging procedure.

Typically, such agents are injected into a patient's vasculature prior to a medical imaging procedure. More specifically, prior to injection, the agent is extracted from a glass or plastic storage vessel, generally through a syringe, which penetrates into the vessel through a resealable rubber stopper. As will be appreciated, given that the agents are injected into patients, it is important that the vessel and its contents have not been tampered with, e.g., diluted or counterfeited, or otherwise compromised such as by being exposed to air or moisture prior to initial use. To this end, some vessels used to store such agents are secured with caps that have tamper evident bands. Such bands, however, are typically welded in place, and, due to manufacturing variations; the force needed to break them and remove the cap can range from 50 to 100N. As will be appreciated, the grip strength of imaging technicians and staff can vary, and some may have a difficult time breaking the bands to use the media.

Moreover, other caps employ pull rings attached to tabs as a closure mechanism. In use, the pull ring is lifted to pull a tab back to expose a stopper through which the agent is extracted. In certain circumstances, however, it may be possible glue or otherwise reaffix the tab after an initial use, without any obvious external indicia of tampering.

In view of the above, a need exists for a cap apparatus for a vessel that provides a durable seal against air and moisture, reliable and obvious indicia of tampering, and a controllable, moderate removal/break force.

BRIEF DESCRIPTION

In an embodiment, an apparatus for securing a vessel includes a primary cap having a threaded portion that is configured to selectively engage corresponding threads of a vessel to secure the primary cap to the vessel, and at least one projection. The apparatus further includes a removable secondary cap configured to engage the primary cap to secure the vessel, the secondary cap including at least one lug, the lug having a shear zone that contacts the projection when the primary and secondary caps are engaged and secured to a vessel. When the secondary cap is removed from the primary cap, the shear zone is broken by the projection such that the secondary cap cannot by reinstalled on the primary cap.

In another embodiment, a pre-assembled tamper evident storage apparatus includes a vessel having a body and a threaded neck portion, a primary cap having a threaded portion configured to selectively engage the threaded neck portion of the vessel, and at least one projection. The apparatus further includes a removable secondary cap in engagement with the primary cap to secure the vessel, the secondary cap including at least one lug having a shear zone that contacts the projection. When the secondary cap is removed from the primary cap, the shear zone is broken by the projection such that the secondary cap cannot reengage the primary cap.

In yet another embodiment, a method of securing a vessel includes the steps placing a primary cap having a threaded portion on a threaded neck portion of a vessel, the primary cap including a removable secondary cap and rotating the primary cap in a first direction thereby tightening the primary cap on the vessel neck. The method further includes rotating the secondary cap in a second opposite direction until a lug on the secondary cap engages a projection of the primary cap such that the secondary cap cannot be removed without breaking a portion of the lug thereby preventing the secondary cap from being reinstalled on a vessel.

In an additional embodiment, an apparatus for securing a vessel includes a primary cap having configured to selectively engage a vessel to secure the primary cap to the vessel, and at least one projection and a removable secondary cap configured to engage the primary cap to secure the vessel, the secondary cap including at least one lug, the lug having a shear zone that contacts the projection when the primary and secondary caps are engaged and secured to a vessel. When the secondary cap is removed from the primary cap, the shear zone is broken by the projection such that the secondary cap cannot by reinstalled on the primary cap.

DRAWINGS

The present invention will be better understood from reading the following description of non-limiting embodiments, with reference to the attached drawings, wherein below:

DETAILED DESCRIPTION

Figure 1:
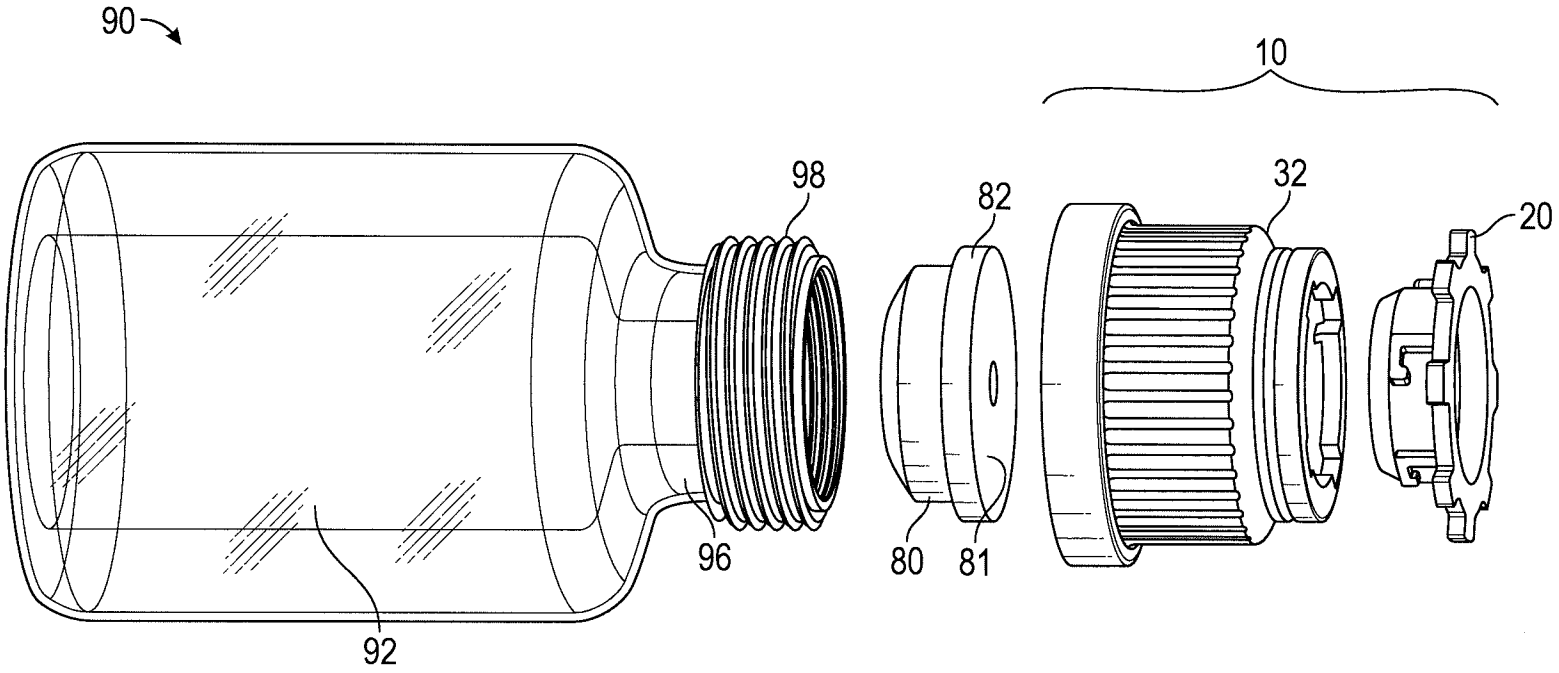
FIG. 1 is an exploded perspective view of an apparatus for securing a vessel in accordance with an embodiment of the invention.

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly.

Moreover, as used herein, the term "imaging media" includes, but is not limited to, contrast media, which, in turn includes any suitable media that is injected into a patient to highlight selected areas of a patient's body, e.g., tissue and fluids. In addition, "imaging media" may also refer to other diagnostic or therapeutic agents for injection into patient, including flushing agents, such as a saline solution.

Further, embodiments of the present invention may be used in connection with media generally and are not limited to any particular type of imaging, media, tissue or fluid. Further still, while the embodiments disclosed herein are described with respect to securing and storing imaging media, it is to be understood that embodiments of the present invention may be applicable to any other type of media, i.e., liquid, solid and/or gas, that require storage. In view of the above, the term "contents" of a vessel is meant to be non-limiting and is intended to include all of the aforementioned media.

Referring now to FIG. 1, an embodiment of the inventive apparatus 10 for securing a vessel is depicted. As shown, the apparatus 10 generally includes a primary cap 32 and a secondary cap 20, a portion of which extends within an open interior of the primary cap 32 when installed. As will be appreciated, in embodiments, the caps 32, 20 are configured for installation on a bottle or vessel 90 having a threaded portion to secure the same. That is, the primary cap 32 is secured to the vessel 90 and the secondary cap 20 is secured to the primary cap 32. Exemplary vessels, i.e., vessel 90, have a body 92 with a substantially hollow interior that holds imaging or other media. As shown, the vessel 90 also has a neck portion 96 that includes a plurality of threads 98. In other aspects, the inventive apparatus 10 may be secured to a vessel via alternative attachment means, other than threads. The vessel 90 may be manufactured from a variety of materials including plastic and glass.

Embodiments of the apparatus are suitable for use with a stopper 80 that seals the substantially hollow interior of the vessel 90. The stopper 80 may be a natural or synthetic septum type stopper with a flange portion 82 that abuts the neck portion 98 when installed. The stopper 80 may also include a diaphragm or central aperture 81 through which the contents of the vessel 90 can be extracted through the use of a syringe (not shown). The central aperture 81 may be resealable after contents of the vessel 90 are withdrawn via syringe.

Figure 2:
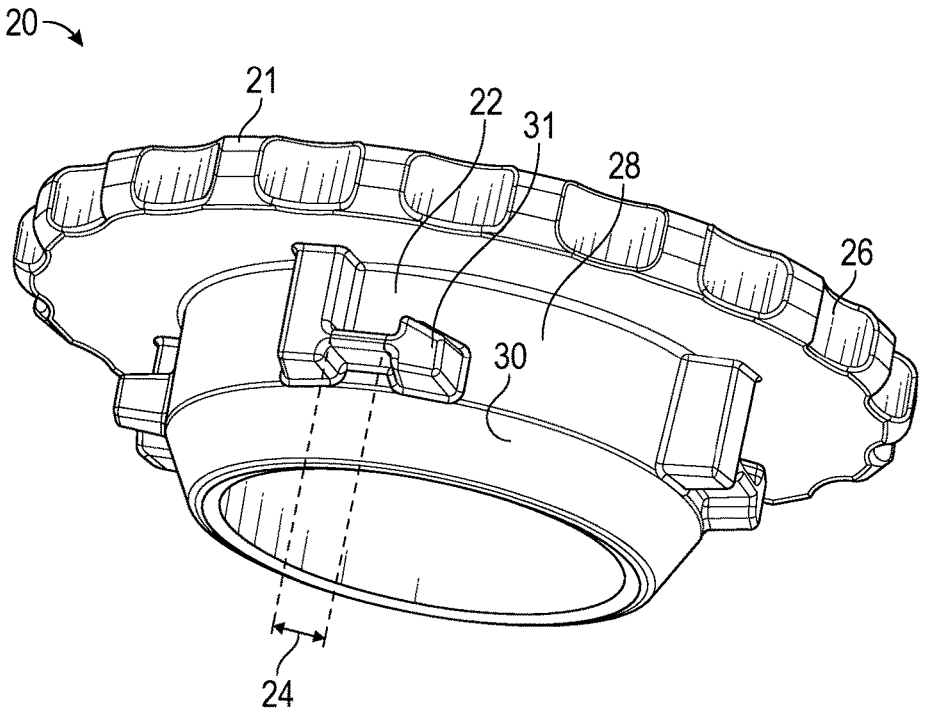
FIG. 2 is a perspective view of a secondary cap of the apparatus of FIG. 1.
Figure 3:
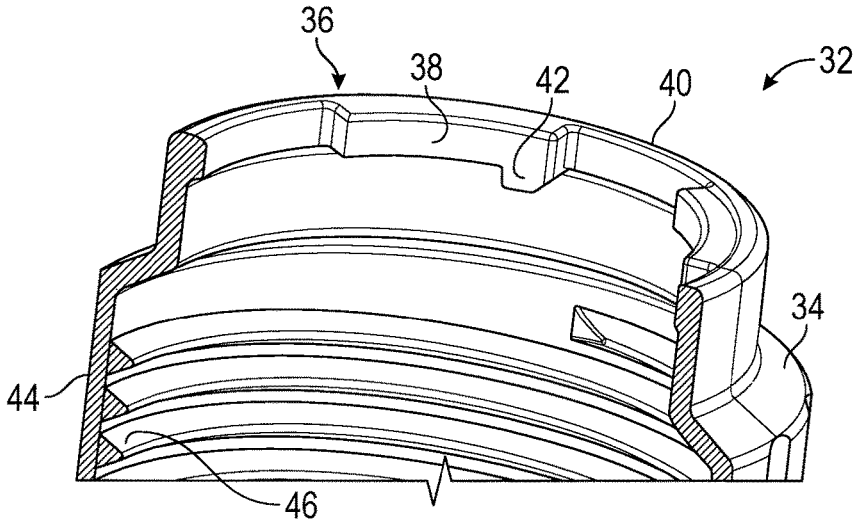
FIG. 3 is a perspective view of a primary cap of the apparatus of FIG. 1.

Referring now to FIGS. 2 and 3, an embodiment of the primary cap 32 includes a body 44, the substantially hollow, annular interior of which contains a plurality of threads 46. The primary cap 32 also contains a shoulder portion 34, which is tapered and has a smaller inner diameter than the body 44. The primary cap 32 further includes a latching portion 36, which features a plurality of projections 38 that project inwardly toward the center of the annular interior of the primary cap 32. In close proximity to each projection 38 is an opening 40. The openings 40 allow for a lug 22 on the exterior of the secondary cap 20 to be rotated under the projections 38 so that, during installation, a chamfered portion 42 of the projection, i.e., a "projection chamfered portion," contacts a portion of the lug to secure the caps 20, 32 together.

As mentioned, the secondary cap 20 has an annular body portion 28 that includes a plurality of lugs 22 that are substantially uniformly spaced about the body portion. In embodiments, the lugs 22 are substantially L-shaped and include a lug chamfered edge portion 31, as well as a shear zone 24. The shear zone 24 is a section of lug having a reduced strength, e.g., a reduced thickness or amount of material, so that it may shear or break relatively easily and in a controlled manner, as discussed in greater detail below. The chamfered edge portion 31 of the lug 31 and the chamfered edge portion 42 of the projection 38 are configured such that they slidingly engage each other when the secondary cap 20 is rotated relative to the primary cap 32 until lug 22 passes under the projection 38 such that the projection chamfered edge portion 42 is in contact with the lug shear zone 24. In embodiments, there are a plurality of lugs and corresponding projections, e.g., 3, 4 or more of each. In certain embodiments, there are three of each structure. Though the lugs are described substantially L-shaped, other shapes and configurations may be utilized.

The secondary cap 20 further includes a flange portion 26, which abuts the latching portion 36 of the primary cap 32 when installed thereon. In embodiments, the flange portion 26 may be knurled or textured to facility grasping and removal of the secondary cap 20 from the primary cap 32.

In use, in an embodiment, an imaging technician or the like receives a preassembled vessel containing an imaging medium with the inventive cap apparatus secured thereto. More specifically, in the preassembled process, the primary cap 32 is threaded onto the neck portion of vessel 90, which contains a stopper 82. The secondary cap 20, in turn, is secured to the primary cap 32 via rotation of the same until the caps 20, 32 are fully tightened and the chamfered edge portion 42 of the projection 38 contacts the shear zone 24 of the lug 31. This process is described in greater detail below.

When the imaging technician needs to extract media, he or she would simply lift the secondary cap 20 off the primary cap 32, thereby breaking or shearing the shear zone 24 of the lug 22. That is, the chamfered edge portion 42 of the projection 38 breaks the shear zone 24 when secondary cap 20 is lifted. Once removed, the hollow interior of the primary cap 32 is exposed and the stopper 82 can be accessed to withdraw imaging media. The secondary cap 20 cannot then be re-secured to the primary cap 32, however. In other words, the initial preassembled relationship between caps 20, 32 cannot be recreated, as the shear zone 24 has been broken. In this way, an imaging technician can immediately know if a preassembled storage vessel 90 has been tampered with, as the broken shear zone provides an obvious external indicator of a prior opening of the caps 20, 32.

In embodiments, the caps 20, 32 may be manufactured from a polyurethane, such as a thermoplastic polyurethane (TPU). More specifically, a medical grade TPU may be utilized and the TPU may be polyether or polyester-based. As will be appreciated, other materials may be employed, provided the mechanical properties of the material can be varied to create, for example, a shear zone with a consistent and moderate shear force.

As will be appreciated, the amount of force necessary to break through the shear zone 24 and remove the primary cap can be varied based on the thickness or amount of material of the shear zone, or the type of material that the secondary cap is manufactured from. As such, in embodiments, the amount of force required to remove the secondary cap can be easily varied and consistent shear forces can be obtained. In an embodiment, the shear force is about 60N+/−10N.

The caps 20, 32 may also be manufactured from a transparent, semi-transparent or opaque material, which may be colored. Transparent caps may provide additional indicia of tampering or contamination via exposure to, e.g., moisture.

Figure 4:
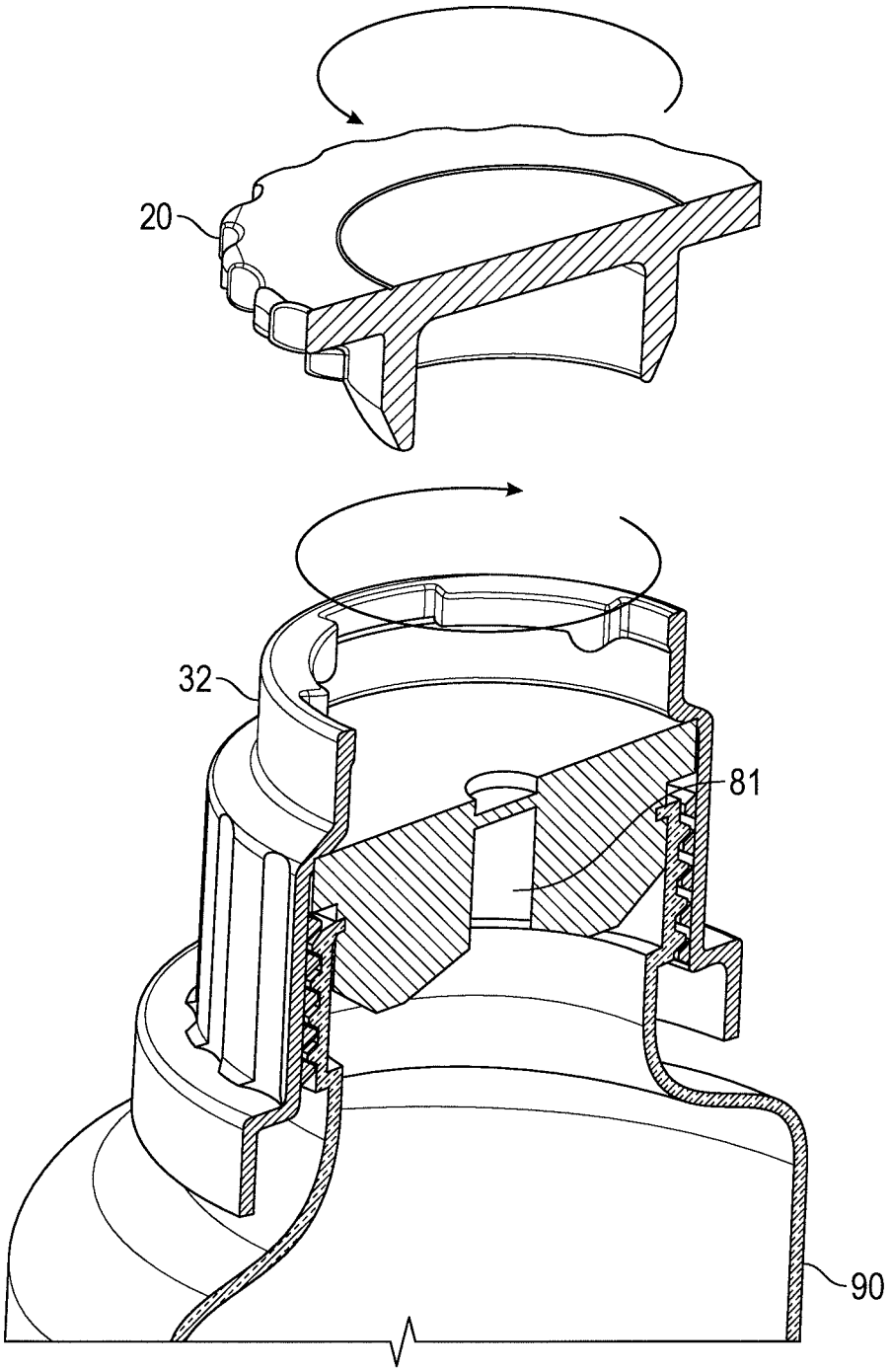
FIG. 4 is a perspective cutaway view of the apparatus of FIG. 1, wherein a main cap is installed on a vessel.

Referring now to FIG. 4, in an embodiment, the primary cap 32 and the secondary cap 20 rotate in opposite directions. That is, the primary cap 32 rotates counterclockwise about threads 98 on the neck portion 96 of the vessel 90 to tighten and secure the primary cap 32 to the vessel. The secondary cap 20 rotates in a direction opposite of the primary cap 32, e.g., counterclockwise.

Figure 5:
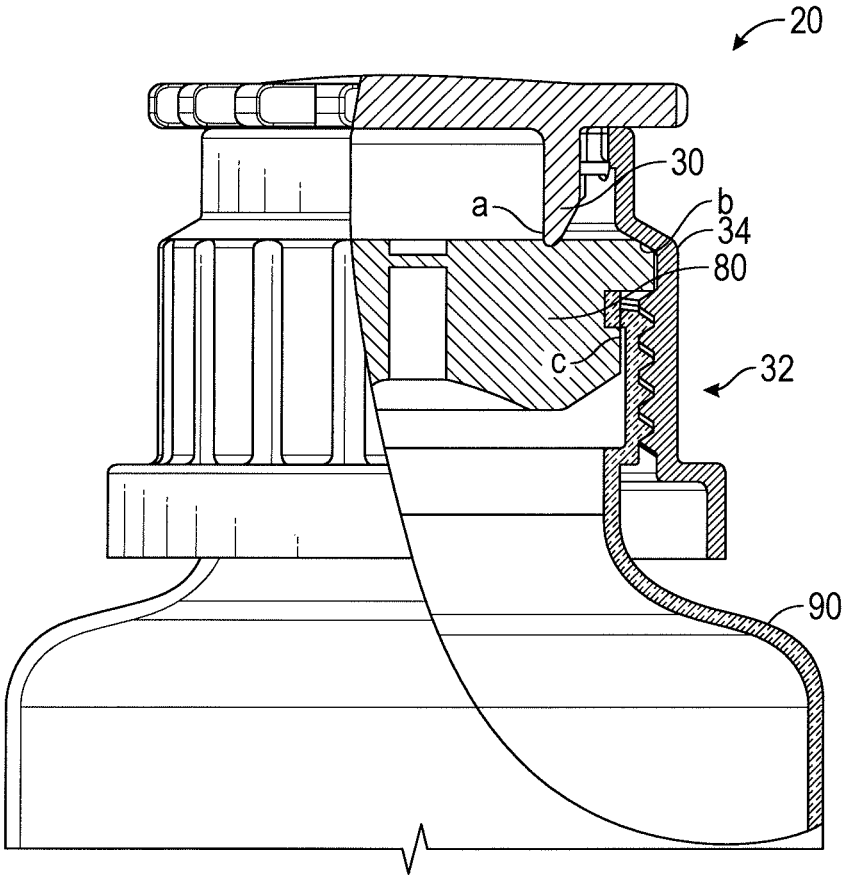
FIG. 5 is a cutaway view of the apparatus of FIG. 1 installed on a vessel.

Turning now to FIG. 5, embodiments of the present invention provide an enhanced degree of vessel sealing beyond that of a stopper alone. More specifically, when installed on a vessel, the caps 20, 32 provide a sealing against contamination via exposure to air and moisture. In particular, the stopper 80 contacts the inner surface of the neck portion of a vessel 90 via an interference fit c which creates a primary seal protecting the hollow vessel interior and its contents. In addition, the shoulder portion 34 of the primary cap 32, when fully threaded on the vessel, presses down on the stopper 80 creating a crush/interference fit b, which provides additional sealing. Finally, the sealing portion 30 of the secondary cap 20 provides a degree of sealing as it contacts the stopper via a crush/interference fit a when the secondary cap 20 engages the primary cap 32. In this manner, embodiments of the inventive apparatus provide multiple sealing points beyond that of a stopper alone and conventional cap systems.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment, an apparatus for securing a vessel includes a primary cap having a threaded portion that is configured to selectively engage corresponding threads of a vessel to secure the primary cap to the vessel and at least one projection. The apparatus further includes a removable secondary cap configured to engage the primary cap to secure the vessel, the secondary cap including at least one lug having a shear zone that contacts the projection when the primary and secondary caps are engaged and secured to a vessel. When the secondary cap is removed from the primary cap, the shear zone is broken by the projection such that the secondary cap cannot by reinstalled on the primary cap. In embodiments, the at least one lug is a plurality of lugs circumferentially spaced on an outer surface of the secondary cap and the at least one lug is a substantially L-shaped and the shear zone is a section of thinned material on the lug. In an aspect, the at least one lug has a lug chamfered edge portion and the projection has a projection chamfered edge portion that is configured to slidably engage the lug chamfered edge portion and allow passage of the projection chamfered edge portion over the lug so that it is in contact with the shear zone of the lug. The secondary cap can further include a body portion, where the at least one projection is located, a flange portion, a seal portion, the seal portion being configured to contact a stopper in a neck of a vessel to assist in sealing the vessel when the caps are installed thereon. The flange portion extends out of the primary cap when the caps are engaged on a vessel, such that the flange portion may be utilized to separate the secondary cap from the primary cap. The seal portion is tapered and the secondary cap is manufactured from a thermoplastic polyurethane. The primary cap further includes a body, the interior of which contains the threaded portion, a shoulder portion, and at least one opening adjacent to the at least one projection, the at least one opening being configured to allow passage of a lug of the secondary cap so that the shear zone of the lug can be rotated into engagement with the projection to secure the caps together on a vessel.

In another embodiment, a tamper evident storage apparatus includes a vessel having a body and a threaded neck portion, a primary cap having a threaded portion configured to selectively engage the threaded neck portion of the vessel, and at least one projection. The apparatus further includes a removable secondary cap in engagement with the primary cap to secure the vessel, the secondary cap including at least one lug having a shear zone that contacts the projection and wherein when the secondary cap is removed from the primary cap, the shear zone is broken by the projection such that the secondary cap cannot reengage the primary cap. In embodiments, the apparatus further includes a stopper located in the threaded neck portion of the vessel, the stopper having a central aperture through which a fluid within the vessel can be extracted. The primary cap includes a shoulder portion and the secondary cap includes a seal portion and the shoulder portion engages the stopper such that it creates an interference fit between the stopper and shoulder portion, and the seal portion of the secondary cap engages the stopper such that it creates an interference fit between the stopper and the seal portion, the shoulder portion and seal portion assist in sealing the vessel. The at least one lug may be substantially L-shaped and the shear zone is a section of thinned material on the lug. The projection may have a chamfered edge portion that it is in contact with the shear zone of the lug.

In yet another embodiment, a method of securing a vessel includes the steps of placing a primary cap having a threaded portion on a threaded neck portion of a vessel, the primary cap including a removable secondary cap and rotating the primary cap in a first direction thereby tightening the primary cap on the vessel neck. The method further includes rotating the secondary cap in a second opposite direction until a lug on the secondary cap engages a projection of the primary cap such that the secondary cap cannot be removed without breaking a portion of the lug thereby preventing the secondary cap from being reinstalled on a vessel. In embodiments, the projection engages a shear zone of the lug when the primary and secondary caps are installed on a vessel. The method further includes the step of placing a stopper in the neck portion prior to placing the primary cap on the neck portion. The primary cap further includes a shoulder portion and the secondary cap includes a seal portion and the shoulder portion engages the stopper such that it creates an interference fit between the stopper and shoulder portion, and the seal portion of the secondary cap also engages the stopper such that it creates an interference fit between the stopper and the seal portion, and the shoulder portion and seal portion assist in sealing the vessel.

In an additional embodiment, an apparatus for securing a vessel includes a primary cap having configured to selectively engage a vessel to secure the primary cap to the vessel, and at least one projection and a removable secondary cap configured to engage the primary cap to secure the vessel, the secondary cap including at least one lug, the lug having a shear zone that contacts the projection when the primary and secondary caps are engaged and secured to a vessel. When the secondary cap is removed from the primary cap, the shear zone is broken by the projection such that the secondary cap cannot by reinstalled on the primary cap.

Additionally, while the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format are not intended to be interpreted as such, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

What is claimed is:

1. An apparatus for securing a vessel comprising:

a primary cap having a threaded portion that is configured to selectively engage corresponding threads of a vessel to secure the primary cap to the vessel, and at least one projection;

a removable secondary cap configured to engage the primary cap to secure the vessel, the secondary cap including at least one lug, the lug being substantially L-shaped and having a shear zone formed by a section of thinned material that contacts the projection when the primary and secondary caps are engaged and secured to a vessel; and wherein when the secondary cap is removed from the primary cap, the shear zone is broken by the projection such that the preassembled relationship between the secondary cap and the primary cap cannot be recreated.

2. The apparatus of claim 1 wherein the at least one lug is a plurality of lugs circumferentially spaced on an outer surface of the secondary cap.

3. The apparatus of claim 1 wherein the at least one lug has a lug chamfered edge portion.

4. The apparatus of claim 3 wherein the projection has a projection chamfered edge portion that is configured to slidably engage the lug chamfered edge portion and allow passage of the projection chamfered edge portion over the lug so that it is in contact with the shear zone of the lug.

5. The apparatus of claim 1 wherein the secondary cap further comprises:

a body portion, where the at least one projection is located;

a flange portion; and a seal portion, the seal portion being configured to contact a stopper in a neck of a vessel to assist in sealing the vessel when the caps are installed thereon.

6. The apparatus of claim 5 wherein the flange portion extends out of the primary cap when the caps are engaged on a vessel, such that the flange portion may be utilized to separate the secondary cap from the primary cap.

7. The apparatus of claim 5 wherein the seal portion is tapered.

8. The apparatus of claim 1 wherein the secondary cap is manufactured from a thermoplastic polyurethane.

9. The apparatus of claim 1 wherein the primary cap further comprises:

a body, the interior of which contains the threaded portion;

a shoulder portion; and at least one opening adjacent to the at least one projection, the at least one opening being configured to allow passage of a lug of the secondary cap so that the shear zone of the lug can be rotated into engagement with the projection to secure the caps together on a vessel.

10. A pre-assembled tamper evident storage apparatus comprising:

a vessel having a body and a threaded neck portion;

a primary cap having a threaded portion configured to selectively engage the threaded neck portion of the vessel, and at least one projection;

a removable secondary cap in engagement with the primary cap to secure the vessel, the secondary cap including at least one substantially L-shaped lug having a shear zone formed by a section of thinned material that contacts the projection; and wherein when the secondary cap is removed from the primary cap, the shear zone is broken by the projection such that the preassembled relationship between the secondary cap and the primary cap cannot be recreated.

11. The pre-assembled tamper evident storage apparatus of claim 10 further comprising:

a stopper located in the threaded neck portion of the vessel, the stopper having a central aperture through which a fluid within the vessel can be extracted.

12. The pre-assembled tamper evident storage apparatus of claim 11 wherein the primary cap includes a shoulder portion and the secondary cap includes a seal portion; and wherein the shoulder portion engages the stopper such that it creates an interference fit between the stopper and shoulder portion, and the seal portion of the secondary cap engages the stopper such that it creates an interference fit between the stopper and the seal portion; and wherein the shoulder portion and seal portion assist in sealing the vessel.

13. The pre-assembled tamper evident storage apparatus of claim 10 wherein the projection has a chamfered edge portion that it is in contact with the shear zone of the lug.

14. A method of securing a vessel comprising the steps of:

placing a primary cap having a threaded portion on a threaded neck portion of a vessel, the primary cap including a removable secondary cap;

rotating the primary cap in a first direction thereby tightening the primary cap on the vessel neck;

rotating the secondary cap in a second opposite direction until a lug on the secondary cap engages a projection of the primary cap such that the secondary cap cannot be removed without the projection breaking a portion of the lug thereby preventing the preassembled relationship between the secondary cap and the primary cap from being recreated; and placing a stopper in the neck portion prior to placing the primary cap on the neck portion.

15. The method of claim 14, wherein the projection engages a shear zone of the lug when the primary and secondary caps are installed on a vessel.

16. The method of claim 14, wherein the primary cap further includes a shoulder portion and the secondary cap includes a seal portion; and wherein the shoulder portion engages the stopper such that it creates an interference fit between the stopper and shoulder portion, and the seal portion of the secondary cap also engages the stopper such that it creates an interference fit between the stopper and the seal portion; and wherein the shoulder portion and seal portion assist in sealing the vessel.

17. An apparatus for securing a vessel comprising:

a primary cap configured to selectively engage a vessel to secure the primary cap to the vessel, and at least one projection;

a removable secondary cap configured to engage the primary cap to secure the vessel, the secondary cap including at least one lug, the lug being substantially L-shaped and having a shear zone formed by a thinned material that contacts the projection when the primary and secondary caps are engaged and secured to a vessel; and wherein when the secondary cap is removed from the primary cap, the shear zone is broken by the projection such that the preassembled relationship between the secondary cap and the primary cap cannot be recreated.

18. An apparatus for securing a vessel comprising:

a primary cap configured to selectively engage a vessel to secure the primary cap to the vessel, and at least one projection;

a removable secondary cap configured to engage the primary cap to secure the vessel, the secondary cap including a plurality of lugs circumferentially spaced on an outer surface of the secondary cap, each lug having a shear zone configured to contact the at least one projection when the primary and secondary caps are engaged and secured to a vessel; and wherein when the secondary cap is removed from the primary cap, at least one of the shear zones is broken by the projection such that the preassembled relationship between the secondary cap and the primary cap cannot be recreated.

19. A pre-assembled tamper evident storage apparatus comprising:

a vessel having a body and a threaded neck portion;

a primary cap having a threaded portion configured to selectively engage the threaded neck portion of the vessel, and at least one projection;

a removable secondary cap in engagement with the primary cap to secure the vessel, the secondary cap including at least one lug having a shear zone that contacts the projection;

a stopper located in the threaded neck portion of the vessel, the stopper having a central aperture through which a fluid within the vessel can be extracted; and wherein when the secondary cap is removed from the primary cap, the shear zone is broken by the projection such that the preassembled relationship between the secondary cap and the primary cap cannot be recreated.

* * * * *